United States Patent [19]

Busler et al.

[11] 3,953,975

[45] May 4, 1976

[54] PREVENTION OF SUBSURFACE SEEPAGE BY ACRYLIC ACID POLYMERS

[75] Inventors: William R. Busler, Park Forest; Donald G. Robinson, Clarendon Hills, both of Ill.

[73] Assignee: Nalco Chemical Company, Oak Brook, Ill.

[22] Filed: Feb. 12, 1975

[21] Appl. No.: 549,266

[52] U.S. Cl. ..... 61/1 R; 61/36 R

[51] Int. Cl.[2] ..... E02B 3/02

[58] Field of Search ..... 61/1 R, 36 R

[56] References Cited

UNITED STATES PATENTS

| | | | |
|---|---|---|---|
| 3,016,713 | 1/1962 | Deming et al. | 61/1 |
| 3,298,982 | 1/1967 | Glenn et al. | 260/23 |
| 3,772,893 | 11/1973 | Eilers | 61/36 X |
| 3,789,613 | 2/1974 | Routson | 61/1 |

*Primary Examiner*—Jacob Shapiro

*Attorney, Agent, or Firm*—John G. Premo; Robert A. Miller; Barry W. Sufrin

[57] ABSTRACT

Porous substrata of small bodies of non-flowing waters are contacted with acrylic acid polymers, having at least 20 percent by weight acrylate, to retard excess water loss due to seepage.

14 Claims, No Drawings

PREVENTION OF SUBSURFACE SEEPAGE BY ACRYLIC ACID POLYMERS

INTRODUCTION

Large, shallow evaporation ponds are often used by industries to dispose of wastes. One of these industries, involves the production of soda ash. The brine effluent is placed in large shallow evaporation ponds. Recently, problems have developed due to seepage of this pond water into the water table. This is caused by either capillary action or fissures in the soil strata. Due to excess seepage, the water table becomes contaminated with excess pollutants.

Pond seepage could be solved by dredging and membrane lining. The useful life of a membrane pond liner is between 10 to 15 years. However, membrane pond liners have limited ability to withstand stresses and are susceptible to laceration, abrasion and puncture. Furthermore, pond operations have to be curtailed for installation and maintenance. It would be useful to the art if a chemical solution were effective to retard severe pond seepage.

Other small bodies of non-flowing waters suffer excessive water loss due to perculation through the soil. Such bodies include but are not limited to fish ponds, farm ponds, golf course ponds and the like. A method is needed to prevent excess seepage from these bodies of water.

Some chemical methods of preventing excess seepage are known to those skilled in the art. Nevertheless, these methods involve contacting the soil with the chemical. Therefore, these methods are not useful for treating existing ponds. It would be useful if there was a chemical method for treating small bodies of water with chemicals that did not require treating the soil first.

OBJECTS

It is an object of this invention to provide a method of restricting pond seepage. It is a further object to provide a chemical solution to prevent excess pond seepage. It is still a further object to restrict pollution due to pond seepage. Further objects will be readily apparent to those skilled in the art.

THE INVENTION

The invention comprises a method of seepage control for bodies of non-flowing water having porous substrata. This method comprises contacting the porous substrata with from 0.001 to 1.0 percent by weight of an acrylic acid polymer having at least 20 percent by weight acrylate.

The porous substrata may be soil, sand, or any other porous substance that forms the sunken surface of the water. The acrylic acid polymers useful in this invention are homopolymers of acrylic acid and copolymers thereof containing at least 20 percent by weight acrylate. Copolymers of acrylic acid are prepared using, for instance, acrylamide, methacrylamide, methacrylic acid, maleic anhydride, acrylonitrile and styrene. Preferably, the acrylic acid polymer is made from 5 to 80 percent by weight of acrylamide and 20 to 95 percent by weight of acrylic acid. This preferred acrylic acid polymer is treated with sodium hydroxide to produce from 20 to 95 percent sodium polyacrylate polymer. In the most preferred embodiment of this invention, the acrylic acid polymer is made from 100 percent acrylic acid and is treated with sufficient caustic to produce nearly 100 percent sodium polyacrylate polymer.

The most important feature of the invention resides in the fact that the acrylic acid polymer used to treat the porous substrate is added to the water contained or contacted by the porous substrate. It is surprising that by thus treating the water rather than directly treating the porous substrate that seepage control can be achieved. Apparently the polymer selectively enters the porous substrate and blocks off the porosity to a degree sufficient to adequately control seepage.

This feature of the invention allows existing ponds and the like to be treated by merely adding the polymers to the water rather than spraying solutions of the polymer onto the porous substrate prior to their being contacted with water.

The acrylic acid polymer can be either a latex or a nonlatex polymer such as powder. Preferably, the latex polymer is used.

The latex polymer is a stable emulsion consisting of an aqueous phase of water and the finely divided acrylic acid polymer, a hydrophobic liquid and a water-in-oil emulsifying agent. The concentration of the aqueous phase in a typical latex polymer is from 75 to 95 percent by weight of the emulsion, with the preferred range being from 75 to 90 percent by weight of the emulsion and the most preferred range is from 80 to 85 percent by weight. The concentration of the acrylic acid polymer is from 20 to 50 percent by weight of the emulsion, with the preferred range being from 25 to 40 percent by weight of the emulsion and the most preferred from 30 to 35 percent by weight.

The acrylic acid polymer used in the latex polymer of this invention is preferably formed by the homopolymerization of acrylic acid. The molecular weight of such a polymer may vary over a wide range but typically is in excess of 300,000 and usually exceeds 1,000,000.

This polymer is then treated with sodium hydroxide to produce at least 20 percent by weight of the acrylate.

The hydrophobic liquid generally comprises from 5 to 25 percent by weight of the emulsion and is inert. The preferred amount of the inert hydrophobic liquid is from 10 to 25 percent by weight of the emulsion and the most preferred amount is from 15 to 20 percent by weight.

Preferred inert hydrophobic liquids are hydrocarbon liquids which include both aromatic and aliphatic compounds Thus, such organic hydrocarbon liquids as benzene, xylene, toluene, mineral oils, kerosenes, napthas and others. A particularly useful oil from the standpoint of its physical and chemical properties is the branch-chain isporaffinic solvent sold by Humble Oil and Refining Company under the tradename "ISOPAR M". Typical specifications of this narrow-cut isoparaffinic solvent are set forth in Table I below:

TABLE I

| Specification Properties | Minimum | Maximum | Test Method |
|---|---|---|---|
| Gravity, API at 60/60°F. | 48.0 | 51.0 | ASTM D287 |
| Color, Saybolt | 30 | — | ASTM D156 |
| Aniline Point °F. | 185 | — | ASTM D611 |
| Sulfur ppm | — | 10 | ASTM D1266[1] |
| Distillation, °F. | — | — | ASTM D86 |
| IBP | 400 | 410 | |
| Dry Point | — | 495 | |

TABLE I-continued

| Specification Properties | Minimum | Maximum | Test Method |
|---|---|---|---|
| Flash Point, °F[2] | 160 | — | ASTM D93 |

[1]Nephelometric mod.
[2]Pensky-Martens Closed Cup

A water-in-oil emulsifying agent is used to emulsify the aqueous phase into the inert hydrophobic liquid to provide the latex polymer. Typically the emulsifying agent is used in the amount from 0.1 to 10 percent by weight of the hydrophobic liquid. Any conventional water-in-oil emulsifying agent can be used such as hexaolecyl sodium phthalate, sodium monooleate, sorbitan monostearate, cetyl or stearyl sodium phthalate, metal soaps and any of the so-called low HLB surfactants which are listed in the Atlas HLB Surfactant Selector.

The latex polymer used in this invention exhibits the ability of rapidly dissolving into aqueous solution. In the presence of a surfactant in a short period of time, the polymer is released in water. Methods for preparing the latex polymer used in this invention are well-known to those skilled in the art.

As mentioned, the acrylic acid polymer is added to small bodies of non-flowing water to retard water loss due to seepage. Of particular interest in this invention is the use of the polymer in evaporation ponds, specifically, soda ash brine evaporation ponds. The polymer may be injected directly into the pond or in the alternative may be injected into the waste stream which is deposited into the pond.

This invention is more fully set forth by the following examples.

The latex polymer used in the practice of this invention was prepared according to the following:

EXAMPLE I

To a 1200 ml. glass reactor was added 227 ml. of water. To this was added 126 mls. of a 50 percent solution of sodium hydroxide. Then, 167 mls. of acrylic acid was added to achieve a pH of 8.3. The monomer solution, thus prepared, is maintained at a temperature below 90°F. with cooling. After the monomer solution has been thoroughly mixed by stirring, 208 mls. of Isopar M is added with stirring for 5 mins. 8.5 ml. of Span 80 (sodium monostearate) is added and the mixture is agitated for 10 mins. The reaction is performed under a nitrogen atmosphere by purging the reactor with nitrogen gas. Then, 0.7 percent by weight of the acrylic acid of Vazo 64 catalyst is added to the reaction vessel with stirring. The reactor charge is heated to approximately 115°F. with a nitrogen purge of 40 percent. The temperature is maintained at 115°F. for 30 mins., at which time the reaction should begin. As the temperature increases to approximately 117°F., cooling should be applied to the reaction vessel to maintain the temperature between 115° to 117°F. The reaction is allowed to proceed for approximately 3½ hours at a temperature of 115° to 117°F.

If the temperature drops to as low as 113.5°F., the cooling jacket should be removed to allow the temperature to rise to 117° to 119°F. After the 3½ hour reaction time, the temperature is increased to 124° to 126°F. and maintained within this range for an additional 1½ hours. The reaction temperature is then increased to 135°F. over a 30 minute period and maintained at 135°F. ± 1°F. for 2 hours. The temperature is then increased to 170°F. and 1 to 10 psig pressure with nitrogen applied and maintained for 1 hour. Afterwards the reactor is vented and the temperature is allowed to cool to 90°F. The reaction is complete and the latex polymer is formed.

EXAMPLE II

In order to evaluate the efficiency of the use of the latex polymer prepared in Example I for seepage control of non-flowing waters, a soda ash brine effluent from a shallow evaporation pond located in the Wyoming area was tested. In order to approximate the seepage problem in the soda ash process effluent evaporation pond at 42.88 inch, open-ended column having a two inch diameter was constructed. A soil sample from the subsurface near the pond having the following physical properties was packed into the lower 16 inches of the column:

Physical properties of the soil:

| | |
|---|---|
| Density | 2.5 g/cc. |
| Core Sample Density | 1.8 g/cc. |
| Column Density | 1.6 g/cc. |
| Soil Volume in Column | 823 cc. |
| Soil Weight in Column | 1203 g. |

The column, soil end down was placed in a large beaker having cotton balls in the beaker. To the test column was then added 14.88 inches (767 cc.) of the soda ash effluent having a pH of 11.0, leaving a 12 inch void above the surface of the pond water.

A column of similar dimensions was filled exclusively with the same pond water, leaving the same 12 inch void above the surface of the pond water. This column served as a control for the evaporative loss of pond water.

The test column water loss readings were taken approximately every 24 hours. In each case, the evaporative loss was subtracted from this reading to yield the fluid loss due to the column seepage. The test column was usually refilled after each daily reading. These readings were taken until a reasonably constant seepage loss figure was arrived at.

The pond water in the test columns contained 500 ppm of the latex polymer formed in Example I based upon the total fluid volume of the column. The test column seepage loss was monitored in the same manner as above for a period of 11 days. During this time no additional latex polymer was added to the column with the pond water periodically required to refill the column.

After the eleven day period, all the remaining pond water was removed from the test column. The test column was filled with untreated pond water. The seepage loss of the test column was monitored for 6 days in the manner previously described. Then the top 2.0 inches of soil were physically suspended using a long metal stirring rod for a period of about one minute. The seepage loss of the test column was monitored for 13 days in the manner described above. The data from these tests are presented below:

TABLE II

| Date | Time | Column Fluid Volume (cc) | ΔTime (min) | ΔVolume Due to Seepage (cc) | Volume Loss Rate (cc/min) | Latex Polymer Dose Based on Total Influent (ppm) | Latex Polymer Dose Based on Present Column Volume (ppm) |
|---|---|---|---|---|---|---|---|
| 1 | 4:20 pm | 767 | | | | | |
| 2 | 9:51 am | 653 | 1051 | 112 | 0.11 | | |
| | 9:57 am | 767 | | | | | |
| 3 | 8:38 am | 598 | 1359 | 166 | 0.12 | | |
| | 8:59 am | 767 | | | | | |
| 4 | 4:24 pm | 494 | 1883 | 268 | 0.14 | | |
| | 4:30 pm | 767 | | | | | |
| 7 | 8:39 am | 125 | 3849 | 635 | 0.16 | | |
| | TEMPORARILY TERMINATED TEST | | | | | | |
| 20 | 8:51 am | 767 | | | | | |
| | 2:57 pm | 670 | 366 | 95 | 0.26 | | |
| 22 | 8:57 am | 157 | 2520 | 602 | 0.24 | | |
| | 9:06 am | 767 | | | | | |
| 23 | 8:49 am | 343 | 1423 | 418 | 0.29 | | |
| | 8:53 am | 767 | | | | | |
| 24 | 8:32 am | 356 | 1419 | 406 | 0.29 | | |
| | 8:40 am | 767 | | | | | |
| 25 | 10:55 am | 329 | 1575 | 432 | 0.27 | | |
| | 11:00 am | 767 | | | | | |
| 26 | 12:04 pm | 430 | 1444 | 334 | 0.23 | | |
| | 12:10 pm | 767 | | | | | |
| Average Rate 20th day to 27th day | | | 10,027 | 2623 | 0.26 ± .03 | | |
| 27 | 8:30 am | 429 | 1240 | 335 | 0.27 | | |
| | 9:34 am | 767[1] | | | | 500 | 500 |
| 28 | 9:37 am | 680 | 1447 | 81 | .06 | 500 | 504 |
| 29 | 9:49 am | 631 | 1512 | 45 | .03 | 500 | 507 |
| 30 | 8:56 am | 593 | 1387 | 35 | .03 | 500 | 509 |
| 31 | 8:46 am | 559 | 1430 | 30 | .02 | 500 | 512 |
| 32 | 11:44 am | 522 | 1618 | 33 | .02 | 500 | 516 |
| 33 | 5:10 pm | 487 | 1766 | 30 | .02 | 500 | 521 |
| 34 | 8:37 am | 469 | 927 | 14 | .02 | 500 | 525 |
| | 8:43 am | 767[2] | | | | 234[3] | 321[4] |
| 37 | 11:43 am | 672 | 4500 | 87 | .02 | 234 | 324 |
| 38 | 8:35 am | 649 | 1253 | 21 | .02 | 234 | 325 |
| | 8:50 am | 767[5] | | | | 146[6] | 0 |
| 40 | 1:55 pm | 707 | 3185 | 54 | .02 | 146 | 0 |
| 42 | 9:58 am | 664 | 2643 | 39 | .01 | 146 | 0 |
| 44 | 10:58 am | 617 | 2940 | 42 | .01 | 146 | 0 |
| 48 | 8:45 am | 538 | 5627 | 68 | .01 | 146 | 0 |
| 57 | 11:01 am | 393 | 13,096 | 195 | .01 | 146 | 0 |

[1] 299 ml of pond water and 36 ml of 1% latex polymer were added to the column. This gave a total volume of 767 ml of .05% latex polymer.

[2] 298 ml of pond water were added to the column. No latex polymer was added.

(3) $$\frac{[469 \text{ ml} + 30 \text{ ml (evaporation)}]}{298 \text{ ml} + 767 \text{ ml}}(500 \text{ ppm}) = 234 \text{ ppm}$$

(4) $$\frac{469 \text{ ml } (525 \text{ ppm})}{767 \text{ ml}} = 321 \text{ ppm}$$

[5] The column was emptied and filled with fresh pond water. No latex polymer was added.

(6) $$\frac{767 \text{ ml } (500 \text{ ppm}) - 649 \text{ ml } (325 \text{ ppm})}{767 \text{ ml} + 298 \text{ ml} + 767 \text{ ml} - 649 \text{ ml}} = 146 \text{ ppm}$$

[7] The top 2.0 inches of the column soil were mechanically suspended for a brief period of time. They were then allowed to settle back to their normal level.

The test column experienced an average pond seepage rate of 0.26 cc/minute prior to treatment with the latex polymer. Following the addition of 500 ppm of latex polymer, based on the total fluid volume of the column, the pond water seepage rate is shown in Table III below:

TABLE III

| Time Following Latex Polymer Treatment | Seepage Rate (cc/min.) | Decline in the Seepage Rate (%) |
|---|---|---|
| 0 | 0.26 | 0 |
| 24 hrs. | 0.06 | 76.9 |
| 49 hrs. | 0.03 | 88.5 |
| 72 hrs. | 0.03 | 88.5 |
| 96 hrs. | 0.02 | 92.3 |
| 5 days | 0.02 | 92.3 |
| 6 days | 0.02 | 92.3 |
| 7 days | 0.02 | 92.3 |

Also, the results show that diluting the latex polymer in the column by 40 percent 1 week after the initial latex polymer treatment had no affect on the seepage rate of the pond water. Also, no post-treatment increase in the pond water seepage rate (0.02 cc/min.) was experienced despite the complete removal of the latex polymer remaining in the fluid content of the column. Physically suspending the top 2.0 inches of the soil base for a brief period of time had no affect on the seepage rate (0.01 cc/min.) of the pond. While agitating the soil intense flocculation of the solids was noted. Also, rapid recovery of the solid/liquid interface to its previous level took place.

In conclusion, the pond water seepage rate of the test column continually declined from 0.26 cc/min. to 0.02 cc/min. following a 500 ppm treatment of latex polymer. This was despite successive dilutions of the latex polymer treatment and solid disruptions that are referred to above. There was a 75 percent, 90 percent and 96 percent reduction in the seepage rate after 24 hours, 96 hours and three weeks respectively after treatment.

Certain monomers were copolymerized with acrylic acid to produce copolymers useful in the practice of this invention. The amount of the acrylic acid varied from 20 to 95 percent by weight and the other monomer from 5 to 80 percent by weight. The following Table lists some of these copolymers:

TABLE IV

| Monomer | % by Weight Based on Acrylic Acid |
|---|---|
| 1. acrylamide | 40% |
| 2. acrylamide | 60% |
| 3. styrene | 20% |
| 4. methacrylic acid | 50% |
| 5. maleic anhydride | 40% |
| 6. vinyl acetate | 20% |

In similar tests to those performed in Table II, these copolymers were also useful in retarding excess water loss due to seepage.

In addition to latex polymers, the acrylic acid polymers of this invention include non-latex acrylic acid polymers. For instance, dry powders of the acrylic acid polymers can be dispersed in the small bodies of water to prevent the water seepage.

In the practice of this invention, the dried polymer may be directly dispersed into the pond or small body of water to be treated, or else, the dried polymer may be first dispersed in water to make an aqueous solution or dispersion to be used to treat the body of water. The latex polymer and the non-latex polymer have been found to be equally effective in treating porous substrata.

Thus, the invention shows that acrylic acid polymers are useful in reducing or retarding excess water loss in small, nonflowing bodies of water, by contacting the porous substrata either directly with the polymer, or indirectly by contacting the body of water.

What we claim and desire to protect by Letters Patent is:

1. A method of seepage control for bodies of nonflowing water in contact with porous substrata, which comprises contacting said porous substrata with from 0.001 to 1.0 percent by weight of an acrylic acid polymer, said polymer having at least 20 percent by weight of an acrylate group, said contacting being made by adding the acrylic acid polymer to the body of water in contact with said porous substrate.

2. The method of claim 1 wherein said acrylic acid polymer is a latex polymer, comprising a water-in-oil emulsion which contains dispersed therein a finely divided sodium polyacrylate polymer.

3. The method of claim 2 wherein said latex polymer comprises an aqueous phase, a hydrophobic liquid and a water-in-oil emulsifying agent.

4. The method of claim 3 wherein said aqueous phase comprises water and finely divided sodium polyacrylate.

5. The method of claim 3 wherein said hydrophobic liquid is from 5 to 25 percent by weight of the emulsion.

6. The method of claim 3 wherein said aqueous phase is from 75 to 95 percent by weight of the latex polymer.

7. The method of claim 3 wherein said water-in-oil emulsifying agent is from 0.1 to 1.0 percent by weight of the hydrophobic liquid.

8. The method of claim 1 wherein the acrylic acid polymer is added to the body of water.

9. The method of claim 1 wherein the amount of acrylic acid polymer is from 0.01 to 1.0 percent by weight.

10. The method of claim 1 wherein the amount of acrylic acid polymer is from 0.01 to 0.1 percent by weight.

11. The method of claim 1 wherein the acrylic acid polymer is a copolymer of acrylic acid and a monomer selected from the group consisting of acrylamide, methacrylamide, methacrylic acid, maleic anhydride, acrylonitrile and styrene.

12. The method of claim 1 wherein the acrylic acid polymer is a copolymer of acrylic acid and acrylamide.

13. The method of claim 1 wherein the body of nonflowing water is an evaporation pond.

14. The method of claim 1 wherein the body of nonflowing water is a soda ash brine evaporation pond.

* * * * *